US008628344B2

(12) United States Patent
Cole

(10) Patent No.: US 8,628,344 B2
(45) Date of Patent: Jan. 14, 2014

(54) CONNECTOR AND TERMINAL POSITIONING MECHANISM

(75) Inventor: Bryan D. Cole, Plymouth, MI (US)

(73) Assignee: Yazaki North America, Inc., Canton, MI (US)

( * ) Notice: Subject to any disclaimer, the term of this patent is extended or adjusted under 35 U.S.C. 154(b) by 147 days.

(21) Appl. No.: 13/271,897

(22) Filed: Oct. 12, 2011

(65) Prior Publication Data

US 2013/0095692 A1 Apr. 18, 2013

(51) Int. Cl.
*H01R 13/627* (2006.01)

(52) U.S. Cl.
USPC ..... 439/352; 439/595

(58) Field of Classification Search
USPC ..... 439/352, 489, 595
See application file for complete search history.

(56) References Cited

U.S. PATENT DOCUMENTS

| | | | | |
|---|---|---|---|---|
| 5,147,988 | A | 9/1992 | Appleton | |
| 5,605,471 | A * | 2/1997 | Plyler | 439/489 |
| 5,605,472 | A | 2/1997 | Sakai et al. | |
| 6,059,595 | A | 5/2000 | Lacrouts-Cazenave | |
| 6,325,648 | B1 | 12/2001 | Bilezikjian et al. | |
| 6,648,669 | B1 | 11/2003 | Kim et al. | |
| 6,746,258 | B2 | 6/2004 | Kikuchi et al. | |
| 6,761,570 | B2 | 7/2004 | Patterson et al. | |
| 6,908,329 | B2 * | 6/2005 | Kozono et al. | 439/352 |
| 7,217,150 | B2 | 5/2007 | Lekic et al. | |
| 7,252,530 | B2 * | 8/2007 | Shamoto | 439/352 |
| 7,300,313 | B1 | 11/2007 | Whiteman, Jr. et al. | |
| 7,442,065 | B2 * | 10/2008 | Kuwayama | 439/352 |
| 7,500,869 | B2 | 3/2009 | Wang | |
| 7,980,887 | B2 * | 7/2011 | Urano et al. | 439/489 |
| 2008/0274628 | A1 | 11/2008 | Chauvelier et al. | |
| 2010/0041266 | A1 | 2/2010 | Data et al. | |

OTHER PUBLICATIONS

Cid, Robert."Technology evolution: PTC arc-suppressed connectors, New interconnect technologies can limit potential safety hazards in HVdc applications." Hearst Electronic Products website: www2.electronicproducts.com. Article posted on Jul. 2, 2011. Accessed Sep. 13, 2011, <http://www2.electronicproducts.com/Technology_evolution_PPTC_arc_suppressed_conne . . . >.

* cited by examiner

*Primary Examiner* — Hien Vu
(74) *Attorney, Agent, or Firm* — Harness, Dickey & Pierce, P.L.C.

(57) ABSTRACT

A connector assembly according to the principles of the present disclosure includes a first connector and a second connector. The first connector includes a first connector housing and a sliding mechanism. The first connector housing includes a first power terminal cavity and a retaining member. The sliding mechanism slidably engages the first connector housing and includes a first locking member fixed to a first signal terminal cavity. The first locking member includes a first projection. The retaining member may be configured to engage the first projection when the first connector is disconnected from the second connector such that the first signal terminal cavity is maintained in an axially retracted position relative to the first power terminal cavity.

20 Claims, 7 Drawing Sheets

CONNECTOR AND TERMINAL POSITIONING MECHANISM

FIELD

The present disclosure relates to electrical connectors, and more particularly, to connector and terminal positioning mechanisms.

BACKGROUND

This section provides background information related to the present disclosure which is not necessarily prior art.

Connectors may include connector position assurance (CPA) features and/or terminal position assurance (TPA) features. CPA features may ensure that the connectors are mechanically connected. TPA features may ensure that the terminals disposed within the connectors are electrically connected. In addition, CPA features and TPA features may provide visual, audible, and/or tactile feedback indicating a mechanical or electrical connection. The tactile feedback may include multi-step connections or disconnections that can only be performed in a certain order.

CPA features and TPA features are typically separate or inefficiently combined. As a result, the structure and operation of a connector that includes both CPA features and TPA features may be relatively complex.

SUMMARY

This section provides a general summary of the disclosure, and is not a comprehensive disclosure of its full scope or all of its features.

A connector assembly according to the principles of the present disclosure includes a first connector and a second connector. The first connector includes a first connector housing and a sliding mechanism. The first connector housing includes a first power terminal cavity and a retaining member. The sliding mechanism slidably engages the first connector housing and includes a first locking member fixed to a first signal terminal cavity. The first locking member includes a first projection.

The retaining member may be configured to engage the first projection when the first connector is disconnected from the second connector such that the first signal terminal cavity is maintained in an axially retracted position relative to the first power terminal cavity. The second connector may include a second projection. The second projection may be configured to engage the first projection when a first end face of the first connector housing engages a second end face of the second connector housing such that the resilient arm is radially deflected and the first signal terminal cavity is allowed to slide axially toward the second signal terminal cavity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
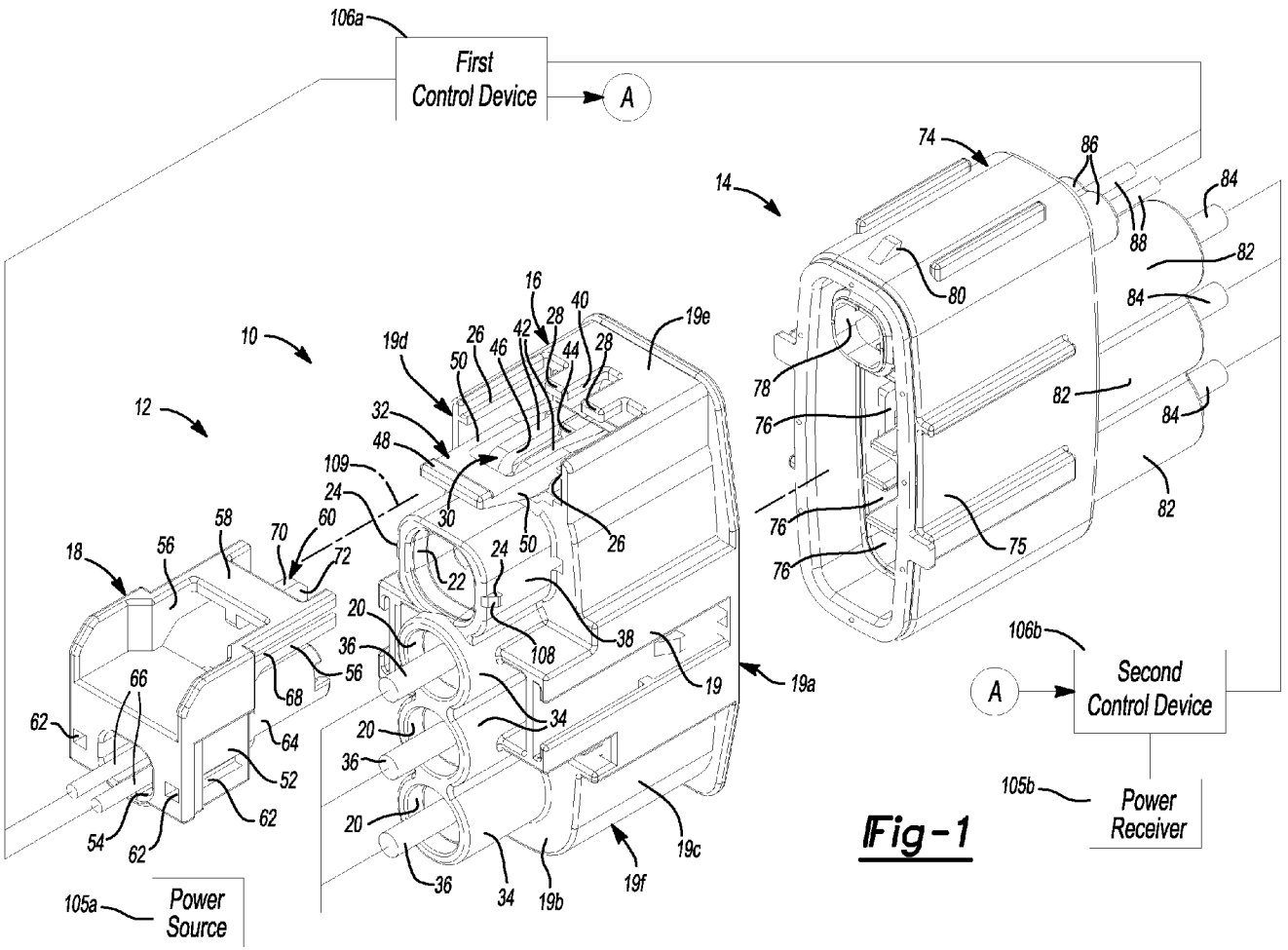
FIG. 1 is an exploded perspective view of a connector assembly according to the principles of the present disclosure, the connector assembly including a first connector and a second connector, the first connector including a first connector housing and a sliding mechanism.

Example embodiments will now be described more fully with reference to the accompanying drawings. Corresponding reference numerals indicate corresponding parts throughout the several views of the drawings.

With reference to FIG. 1, a connector assembly constructed in accordance with the teachings of the present disclosure is generally indicated by reference numeral 10. The connector assembly 10 can include a first connector 12 and a second connector 14.

Figure 2:
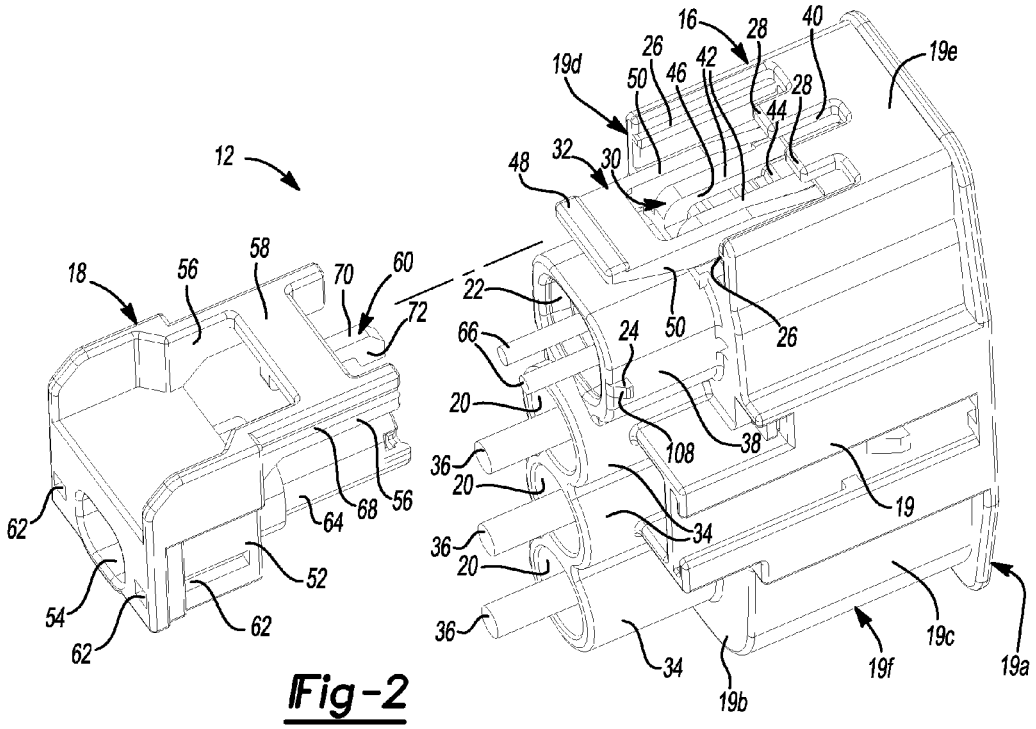
FIG. 2 is an exploded perspective view of the first connector of FIG. 1.

With reference to FIGS. 1 and 2, the first connector 12 can include a first connector housing 16 and a sliding mechanism 18. The first connector housing 16 and/or the sliding mechanism 18 may be injection molded from plastic. The first connector housing 16 is configured to protect and seal terminals (e.g., one or more first power terminals 92 (FIG. 6) and one or more first signal terminals 96 (FIG. 6)) disposed therein.

Figure 6:
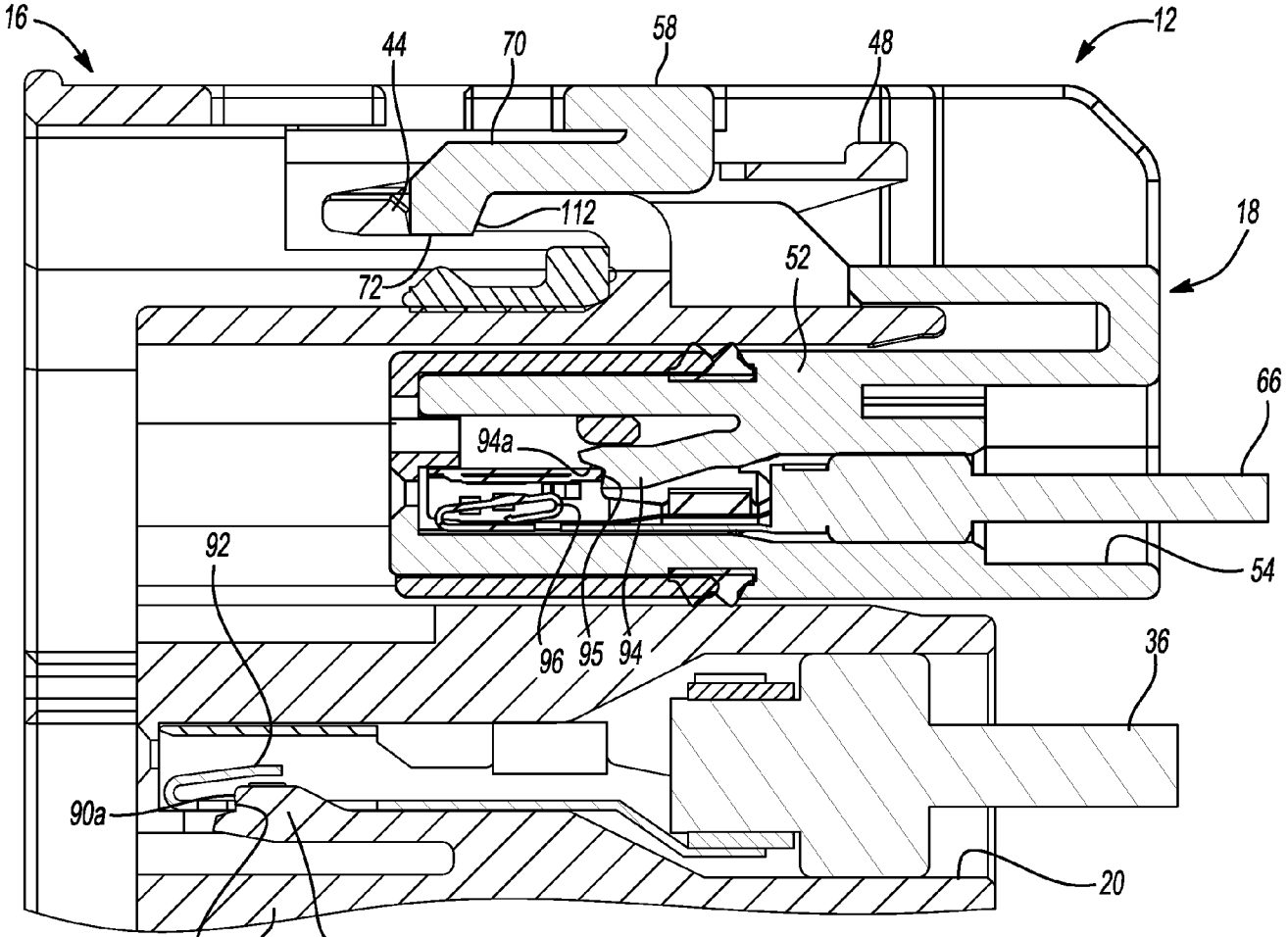
FIG. 6 is a section view of the first connector of FIG. 1 taken along a line 6-6 shown in FIG. 4.

The first connector housing 16 can include a main body portion 19, first power terminal cavities 20, a sliding mechanism receptacle 22, projections 24, guide rails 26, stop members 28, a retaining member 30, and a release member 32. The main body portion 19 can be a generally rectangular shroud having an open end 19*a*, a closed end 19*b*, a first side surface 19*c*, a second side surface 19*d*, an upper surface 19*e*, and a lower surface 19*f*. The first power terminal cavities 20 can extend axially through the first connector housing 16 and may include cylindrical tube portions 34 that can be unitarily formed with and extend rearwardly from the main body portion 19. The first power terminal cavities 20 can be configured to receive and retain the first power terminals 92 (FIG. 6). Power wires 36 can extend rearward from the first power terminal cavities 20.

The sliding mechanism receptacle 22 can be configured to receive a portion of the sliding mechanism 18 and can include a rectangular tube 38 that can be unitarily formed with and extend rearwardly from the main body portion 19. The projections 24 can be configured to engage the sliding mechanism 18 such that the sliding mechanism 18 is releasably retained on the first connector housing 16. The guide rails 26 can be unitarily formed with and extend laterally inward from the main body portion 19 and can be configured to engage the sliding mechanism 18 such that movement of the sliding mechanism 18 is constrained to an axial direction as will be discussed in more detail below.

The stop members 28 can be configured to limit forward movement of the sliding mechanism 18 along the first connector housing 16. In the particular example provided, the stop members 28 are configured to contact the sliding mechanism 18 when the sliding mechanism 18 is positioned at a predetermined position relative to the first connector housing 16. The stop members 28 may comprise projections that can be unitarily formed with the main body portion 19 and can extend rearwardly therefrom. The stop members 28 can define an opening 40 therebetween.

The retaining member 30 can be unitarily formed with the main body portion 19 and can include extension arms 42 and a retaining feature 44 connecting and extending between the extension arms 42. The extension arms 42 can define a channel 46 disposed therebetween. The release member 32 can be unitarily formed with the main body portion 19 and can include a pressing plate 48 and connecting arms 50 that connect the pressing plate 48 to the extension arms 42 of the retaining member 30.

Figure 3:
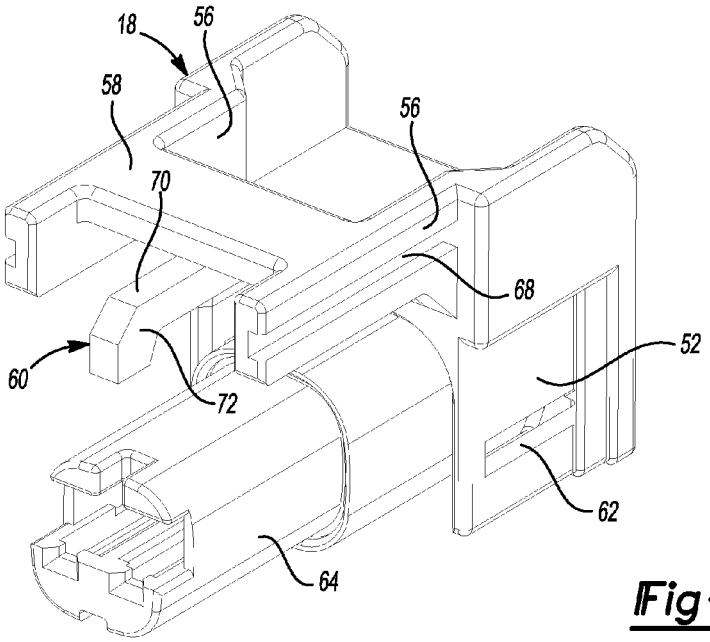
FIG. 3 is a perspective view of the sliding mechanism of FIG. 1.

With reference to FIGS. 2 and 3, the sliding mechanism 18 can include a main body portion 52, a first signal terminal cavity 54, a pair of lateral wall members 56, a cross member 58, and a locking member 60. A pair of slots 62 can be formed in the opposite lateral sides of the main body portion 52. The first signal terminal cavity 54 can extend axially and can be defined by the main body portion 52 and a rectangular tube 64 extending forward from the main body portion 52. The first signal terminal cavity 54 is configured to receive and retain the first signal terminals 96 (FIG. 6). Signal wires 66 can be coupled to the first signal terminals 96 and can extend rearwardly from the first signal terminal cavity 54.

The lateral wall members 56 can define guide channels 68 that can extend axially along the length of the lateral wall members 56. The cross member 58 can extend between and connects the lateral wall members 56. The locking member 60 can include a resilient arm 70 and a locking projection 72. The resilient arm 70 extends axially forward from the cross member 58. The locking projection 72 extends from and is generally perpendicular to the resilient arm 70.

With reference to FIG. 1, the second connector 14 can include a second connector housing 74 configured to protect and seal terminals (e.g., one or more second power terminals 100 (FIG. 7) and one or more second signal terminals 104 (FIG. 7)) disposed therein. The second connector housing 74 may be injection molded from plastic and can include a main body portion 75, one or more second power terminal cavities 76, a second signal terminal cavity 78, and a locking projection 80.

Figure 7:
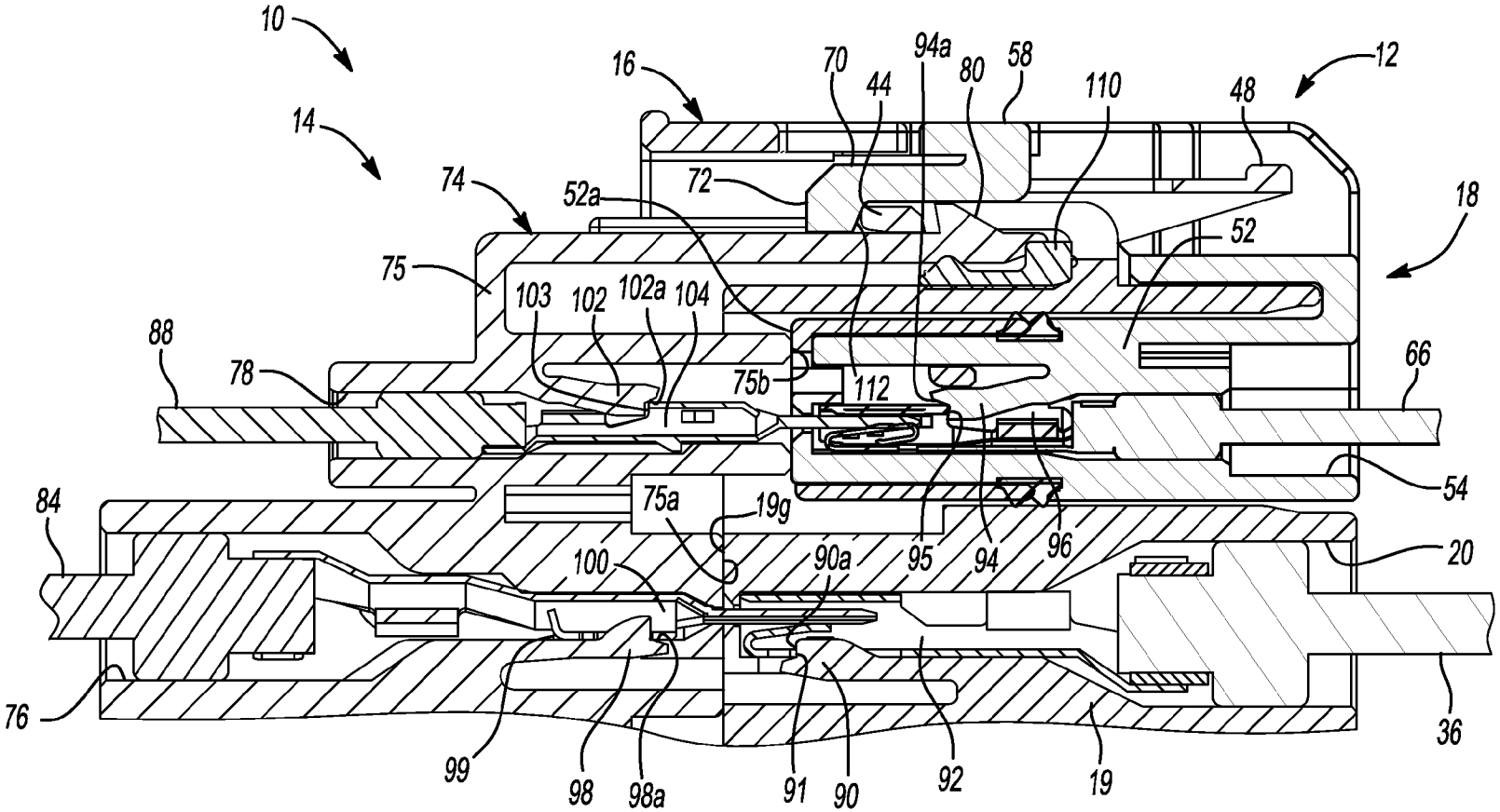
FIG. 7 is a section view of the connector assembly of FIG. 1 taken along a line 7-7 shown in FIG. 5, with the sliding mechanism in the axially advanced position.

The second power terminal cavities 76 can extend axially through the second connector housing 74 and can be defined by the main body portion 75 and cylindrical tubes 82 that extend rearwardly from the main body portion 75. The second power terminal cavities 76 can be configured to receive and retain the second power terminals 100 (FIG. 7). Power wires 84 can be coupled to the second power terminals 100 (FIG. 7) and can extend rearwardly from the second power terminal cavities 76.

The second signal terminal cavity 78 can extend axially through the second connector housing 74 and can be defined by the main body portion 75 and cylindrical tubes 86 that extend rearwardly from the main body portion 75. The second signal terminal cavity 78 can be configured to receive and retain the second signal terminals 104 (FIG. 7). Signal wires 88 can be coupled to the second signal terminals 104 (FIG. 7) and can extend rearwardly from the second signal terminal cavity 78.

Figure 8:
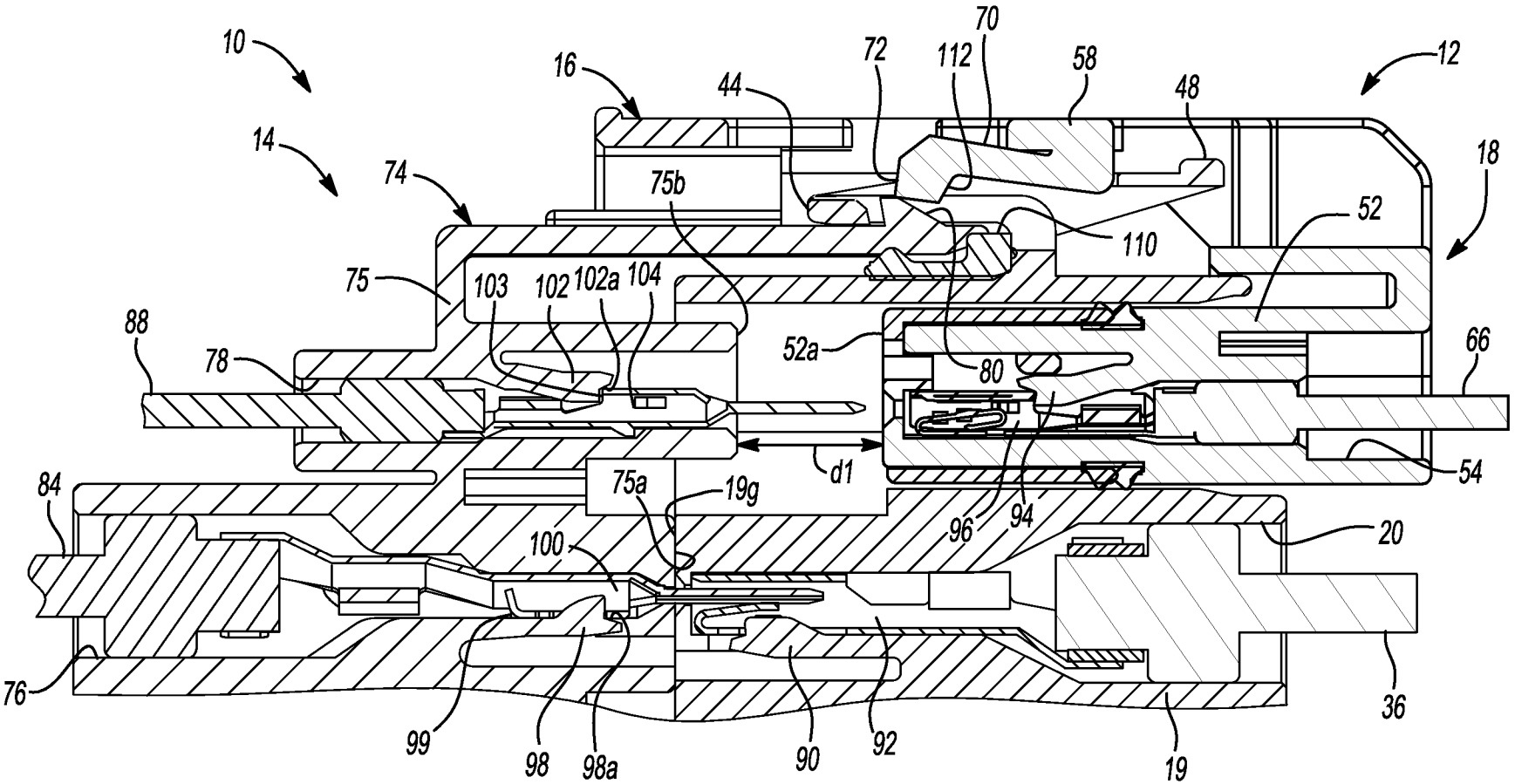
FIG. 8 is a view similar to that of FIG. 7 but illustrating the sliding mechanism in the axially retracted position.

With reference to FIGS. 6 through 8, section views of the connector assembly 10 are shown to illustrate features and interactions between features that are hidden in FIGS. 1 through 5. For simplicity, FIGS. 6 through 8 only show one of the three power terminals shown in FIGS. 1 through 5. In addition, the section views illustrate only one of the two signal terminals shown in FIGS. 1 through 5. However, the discussion below continues to refer to a plurality of power terminals and a plurality of signal terminals, as the power terminals and signal terminals not illustrated may be identical to those illustrated.

With reference to FIGS. 6 and 7, extensions 90 can extend into the first power terminal cavities 20. The extensions 90 can be unitarily formed with and extend from the main body portion 19 of the first connector housing 16. Each of the extensions 90 can be configured to engage a corresponding one of the first power terminals 92 to retain the first power terminals 92 within the first power terminal cavities 20. For example, the extensions 90 can include a recess 90*a* that holds a rearward edge 91 of the first power terminals 92. Extensions 94 can extend into the first signal terminal cavity 54. The extensions 94 can be unitarily formed with and extend from the main body portion 52 of the sliding mechanism 18. Each of the extensions 94 can be configured to engage a corresponding one of the first signal terminals 96 to retain the first signal terminals 96 within the first signal terminal cavity 54. For example, the extensions 94 can include a recess 94*a* that holds a rearward edge 95 of the first signal terminals 96.

Extensions 98 can extend into the second power terminal cavities 76. The extensions 98 can be unitarily formed with and extend from the main body portion 75 of the second connector housing 74. Each of the extensions 98 can be configured to engage a corresponding one of the second power terminals 100 to retain the second power terminals 100 within the second power terminal cavities 76. For example, the extensions 98 can include a recess 98*a* that holds a rearward edge 99 of the second power terminals 100. Extensions 102 can extend into the second signal terminal cavity 78. The extensions 102 can be unitarily formed with and extend from the main body portion 75 of the second connector housing 74. Each of the extensions 102 can be configured to engage a corresponding one of the second signal terminals 104 to retain the second signal terminals 104 within the second signal terminal cavity 78. For example, the extensions 102 can include a recess 102*a* that holds a rearward edge 103 of the second power terminals 100.

The first power terminals 92 are depicted as female power terminals and the second power terminals 100 are depicted as male power terminals. However, the first power terminal cavities 20 may hold male power terminals and the second power terminal cavities 76 may hold female power terminals. In addition, the first signal terminals 96 are depicted as female signal terminals and the second signal terminals 104 are depicted as male signal terminals. However, the first signal terminal cavity 54 may hold male signal terminals and the second signal terminal cavity 78 may hold female signal terminals.

With continued reference to FIG. 1, operation of the connector assembly 10 will now be described. The connector assembly 10 may be used in automotive applications such as an electric vehicle. The electric vehicle may include a power source 105*a*, a power receiver 105*b*, a first control device 106*a*, and a second control device 106*b*. The power source 105*a* can be any type of power source, including batteries, but in the particular example provided, the power source 105*a* is a charge coupler. The power receiver 105*b* can be any device that is configured to receive high power electricity. Coupling the first and second power terminals 92 and 100 can electrically couple the power source 105*a* to the power receiver 105*b*.

The first and second control devices 106*a* and 106*b* can be configured to transmit and/or receive relatively low power electric (control) signals. Coupling the first and second signal terminals 96 and 104 to one another can electrically couple the first and second control devices 106*a* and 106*b* to one another. In the particular example provided, the power receiver 105*b* includes an onboard (battery) charger, the first control device 106*a* is a control module and the second control device 106*b* is a circuit interrupter that is configured to selectively control power transmission between the power source 105*a* and the power receiver 105*b*. The circuit interrupter can be configured to inhibit the transmission of power between the power source 105*a* and the power receiver 105*b* unless a predetermined control signal is communicated between the first and second control devices 106*a* and 106*b*.

With additional reference to FIG. 7, the connector assembly 10 can include features that ensure the connectors 12,14 are locked and the first and second power terminals 92, 100 are mechanically engaged (and thereby electrically connected with one another) before the first and second signal terminals 96, 104 are permitted to mechanically engage one another (to thereby electrically connect with one another). In addition, the connector assembly 10 includes features that ensure the first and second signal terminals 96, 104 are mechanically disengaged before the first and second power terminals 92, 100 are permitted to mechanically disengage. In this manner, the connector assembly 10 can be employed to prevent unintentional disconnections and/or prevents arcing that may otherwise occur if the first and second power terminals 92, 100 are mechanically connected or disconnected when the first and second signal terminals 96, 104 are mechanically connected.

Figure 4:
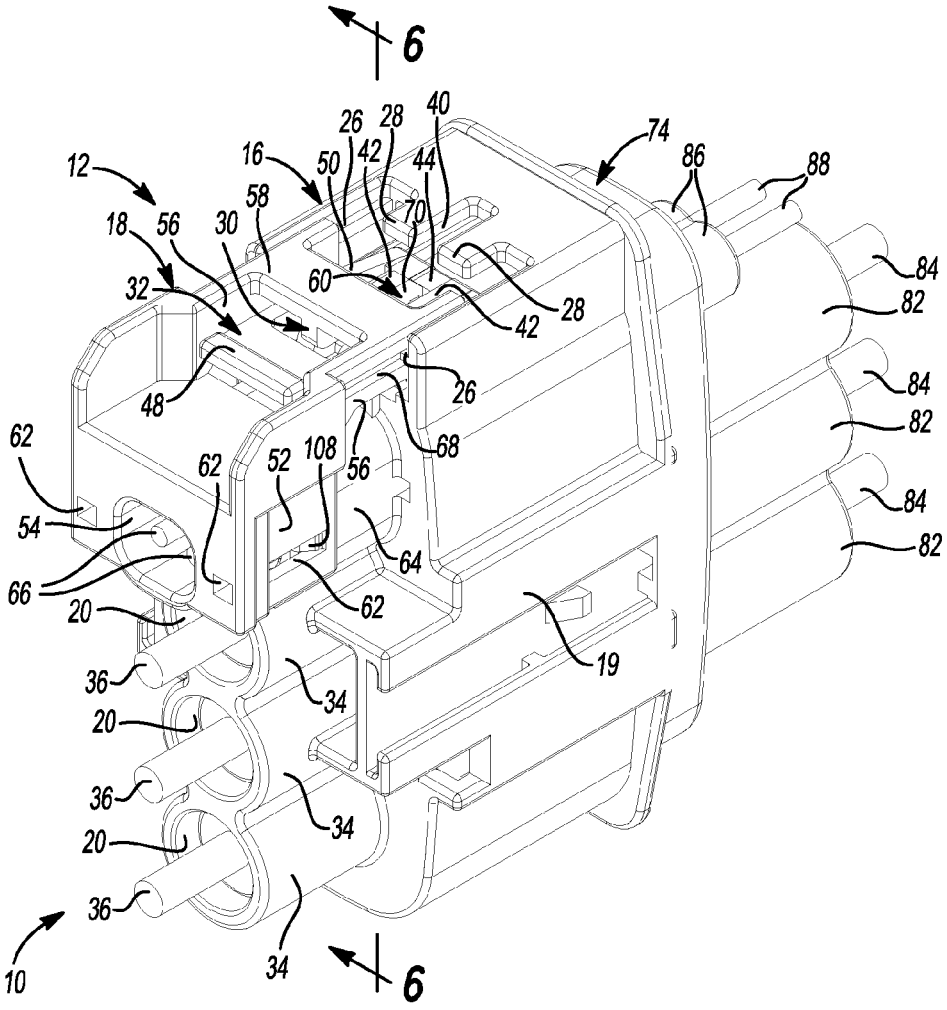
FIG. 4 is a perspective view of the first connector of FIG. 1 with the sliding mechanism in an axially retracted position.

With reference to FIGS. 1, 4, and 6, the sliding mechanism 18 can be assembled to the first connector housing 16 before the first connector 12 is connected to the second connector 14. The rectangular tube 64 of the sliding mechanism 18 can be inserted into the sliding mechanism receptacle 22 of the first connector housing 16 (into the axially retracted position shown in FIGS. 4 and 6). In this position, the guide rails 26 are received into the guide channels 68, and the main body portion 52 of the sliding mechanism 18 has been slid over the rectangular tube 38 of the first connector housing 16 such that the projections 24 are received into the slots 62. It will be appreciated that the projections 24 on the first connector housing 16 may have a ramped surface 108 to reduce the effort required to assemble the sliding mechanism 18.

As the slots 62 are longer than the projections 24, it will be appreciated that the slots 62 and the projections 24 can cooperate to retain the sliding mechanism 18 to the first connector housing 16 in a manner that permits limited movement of the sliding mechanism 18 relative to the first connector housing 16 along a coupling axis 109 through a predetermined range of motion. Additionally, the locking projection 72 on the sliding mechanism 18 has been received into the channel 46 in the first connector housing 16 and can contact the retaining feature 44 to resist further insertion of the sliding mechanism 18 onto the first connector housing 16 (i.e., so that the sliding mechanism 18 is maintained in the axially retracted position).

In FIG. 8, the second connector 14 may be inserted into the first connector 12 until an end face 75*a* of the main body portion 75 engages an end face 19*g* of the main body portion 19. When the end faces 19*g*, 75*a* of the main body portions 19, 75 engage one another, the power terminals 92, 100 are connected. Because the sliding mechanism 18 is in the axially retracted position, the distance d1 between an end face 75*b* of the main body portion 75 and an end face 52*a* of the main body portion 52 is greater than the portion of the blade length of the second signal terminals 104 that extends beyond the end face 75*b* and as such, the first and second signal terminals 96, 104 remain disconnected.

The locking projection 80 of the second connector housing 74 can be slid past the retaining feature 44 on the first connector housing 16 as the second connector 14 is inserted into the first connector 12. The locking projection 80 may have a ramped surface 110, which may reduce the effort required to insert the second connector 14 into the first connector 12. Once the locking projection 80 is slid past the retaining feature 44, the retaining feature 44 can inhibit movement of the second connector 14 in a direction away from the first connector 12 to thereby lock the end faces 19*g*, 75*a* of the main body portions 19, 75 into engagement with one another.

When the locking projection 80 is slid past the retaining feature 44, the ramped surface 110 on the locking projection 80 can engage the locking projection 72 on the sliding mechanism 18 to deflect the locking projection 72 and the resilient arm 70 radially upward such that the locking projection 72 is disengaged from the retaining feature 44 and permits the sliding mechanism 18 to be slid forward in a direction toward the second connector 14.

Figure 5:
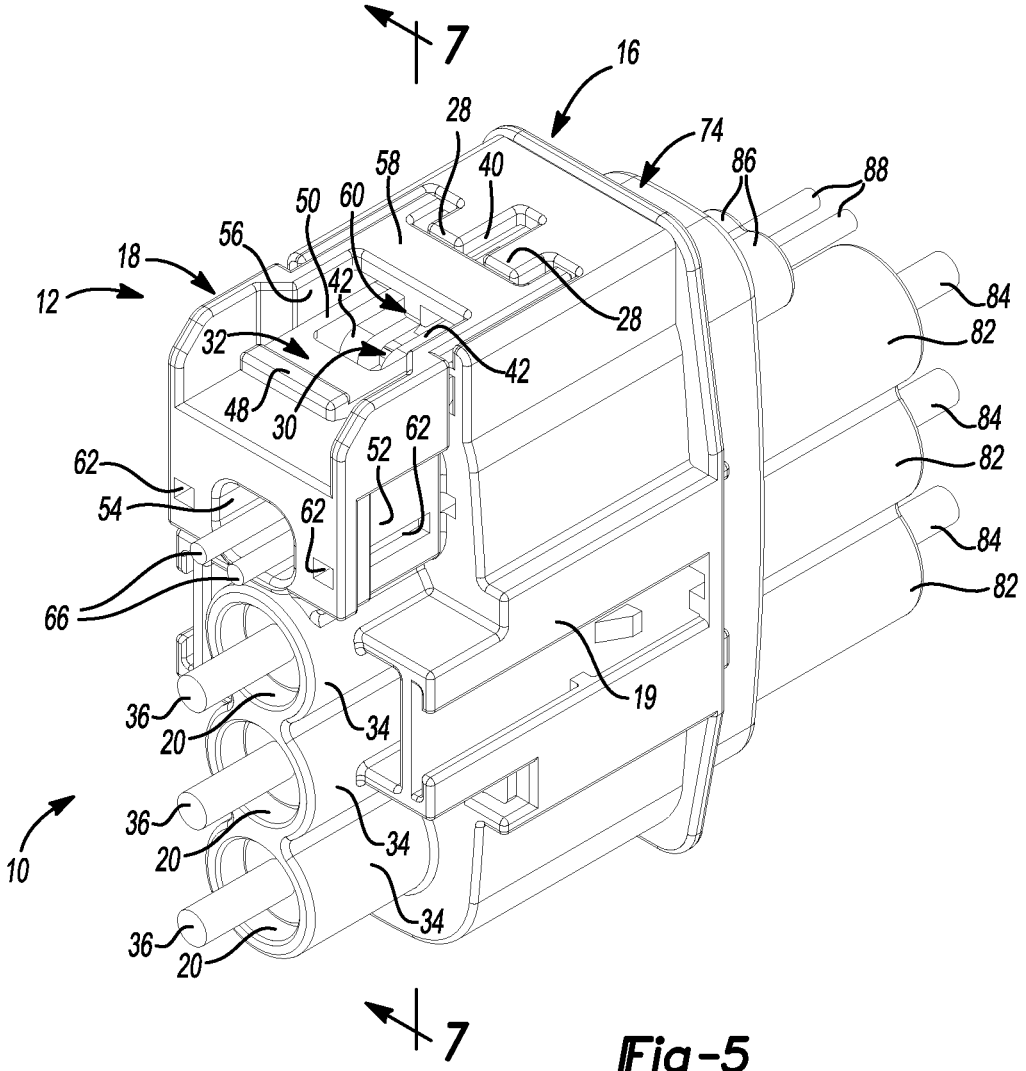
FIG. 5 is a perspective view of the connector assembly of FIG. 1 with the sliding mechanism in an axially advanced position.

With particular reference to FIGS. 5 and 7, the sliding mechanism 18 may be slid forward until the sliding mechanism 18 engages the stop members 28 on the first connector housing 16 in an axially advanced position where the locking projection 72 on the sliding mechanism 18 is rearward of the retaining feature 44 on the first connector housing 16. Additionally, the locking projection 72 may engage the retaining feature 44 to resist rearward movement of the sliding mechanism 18. As a result, the end faces 52*a*, 75*b* of the main body portions 52, 75 may be locked into engagement with one another such that the first and second signal terminals 96, 104 are connected.

To disconnect the first and second connectors 12 and 14 from one another, the sliding mechanism 18 can be slid rearward to the axially retracted position such that the first and second signal terminals 96, 104 are disconnected from one another. As the sliding mechanism 18 is slid rearward, the resilient feature 44 on the first connector housing 16 can engage the locking projection 72 on the sliding mechanism 18 to deflect the sliding mechanism 18 in an upward direction (i.e., away from the second connector housing 74) to mechanically disengage the locking projection 72 from the resilient feature 44. In this regard, the locking projection 72 may include a ramped surface 112 that reduces the effort required to disconnect the signal terminals 96, 104.

When the sliding mechanism 18 is in the axially retracted position, the pressing plate 48 on the first connector housing 16 can be pressed in a downward direction (i.e., toward the rectangular tube 38) to deflect the retaining feature 44 out of engagement with the locking projection 80 on the second connector housing 74. The second connector 14 can then be removed from the first connector 12 such that the first and second power terminals 92, 100 are disconnected from one another.

It will be appreciated that one may not unlock the second connector 14 from the first connector 12 by merely pressing the pressing plate 48 of the first connector housing 16 in a downward direction (i.e., toward the rectangular tube 38) in an attempt to deflect the retaining feature 44 out of engagement with the locking projection 80 on the second connector housing 74.

In this regard, when the sliding mechanism 18 is in the position shown in FIGS. 5 and 7, the resilient arm 70 of the sliding mechanism 18 prevents the retaining feature 44 from deflecting out of engagement with the locking projection 80 so that the second connector 14 cannot be removed from the first connector 12. Consequently, the end faces 52*a*, 75*b* of the main body portions 52, 75 are not allowed to disengage from one another until the end faces 19*g*, 75*a* of the main body portions 19, 75 are disengaged from one another. This prevents arcing that may otherwise occur if the power terminals 92, 100 are disconnected before the signal terminals 96, 104 are disconnected.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A connector assembly, comprising:

a first connector including a first connector housing and a sliding mechanism, the first connector housing including a first power terminal cavity for receiving a first power terminal and a retaining member unitarily formed with the first connector housing and having a retaining feature, the sliding mechanism slidably engaging the first connector housing and including a first locking member unitarily formed with the sliding mechanism and a first signal terminal cavity, the first locking member including a first projection, the first signal terminal cavity being configured to hold a first signal terminal; and a second connector having a second connector housing, wherein the retaining feature of the retaining member engages the first projection when the first connector is disconnected from the second connector such that the first signal terminal cavity is maintained in an axially retracted position relative to the first power terminal cavity.

2. The connector assembly of claim 1, wherein the second connector housing includes a second power terminal cavity, a second signal terminal cavity, and a second projection, the second signal terminal cavity being configured to hold a second signal terminal the second projection being configured to engage the retaining member when a first end face of the first connector housing engages a second end face of the second connector housing such that the first end face of the first connector housing is locked into engagement with the second end face of the second connector housing.

3. The connector assembly of claim 2, wherein a third end face of the sliding mechanism is axially spaced from the second end face of the second connector housing by a first distance when the first signal terminal cavity is in the axially retracted position and the first end face of the first connector housing engages the second end face of the second connector housing.

4. The connector assembly of claim 3, wherein the first distance is configured to be greater than a portion of a blade length of the first signal terminal that extends beyond the third end face of the sliding mechanism.

5. The connector assembly of claim 2, wherein the second projection on the second connector housing has a ramped surface that deflects the first projection on the first locking member in a direction away from the first connector housing when the second power terminal cavity engages the first power terminal cavity such that the first signal terminal cavity is allowed to slide axially toward the second signal terminal cavity.

6. The connector assembly of claim 5, wherein the first projection is configured to engage the retaining feature when the first projection is slid past the retaining feature such that a third end face of the sliding mechanism is locked into engagement with the second end face of the second connector housing.

7. The connector assembly of claim 6, wherein the first locking member resists disengagement of the second projection from the retaining feature when the third end face of the sliding mechanism engages the second end face of the second connector housing.

8. The connector assembly of claim 6, wherein the first connector housing includes a release member that is deflectable to release the second projection from engagement with the retaining feature.

9. The connector assembly of claim 8, wherein the release member includes a pressing plate and connecting arms, the connecting arms connecting the pressing plate to the retaining member.

10. The connector assembly of claim 9, wherein the release member is configured to deflect the retaining member in a first direction when the pressing plate is deflected in a second direction that is opposite from the first direction such that the retaining feature disengages from the second projection.

11. The connector assembly of claim 10, wherein the first locking member resists deflection of the retaining member in the first direction when a third end face of the sliding mechanism engages the second end face of the second connector housing.

12. The connector assembly of claim 1, wherein the first connector housing defines guide rails that engage guide channels in the sliding mechanism such that movement of the sliding mechanism is constrained to an axial direction.

13. The connector assembly of claim 1, wherein the retaining member includes extension arms and the retaining feature.

14. The connector assembly of claim 1, wherein the first locking member includes a resilient arm, the first projection extending from the resilient arm.

15. A connector assembly, comprising:

a first connector including a first connector housing and a sliding mechanism, the sliding mechanism including a first signal terminal cavity for receiving a first signal terminal and a first locking member unitarily formed with the sliding mechanism, the first connector housing including a first power terminal cavity for receiving a first power terminal and a retaining member unitarily formed with the first connector housing, the first locking member slidably engaging the first connector housing and including a resilient arm and a first projection, the retaining member including a retaining feature that is configured to engage the first projection to maintain the first signal terminal cavity an axially retracted position relative to the first power terminal cavity; and a second connector including a second connector housing, the second connector housing including a second power terminal cavity for receiving a second power terminal, a second signal terminal cavity for receiving a second signal terminal, and a second projection, the second projection engaging the first projection when a first end face of the first connector housing engages a second end face of the second connector housing to deflect the first projection and the resilient arm away from the first connector housing such that the first projection is disengaged from the retaining feature and the first signal terminal cavity is allowed to slide axially toward the second signal terminal cavity.

16. The connector assembly of claim 15, wherein the second projection has a ramped surface that engages the first power terminal cavity.

17. The connector assembly of claim 15, wherein the second projection extends from an outer surface of the second connector housing.

18. The connector assembly of claim 15, wherein the retaining member includes axially extending arms and the retaining feature, the retaining feature extending between the arms.

19. The connector assembly of claim 18, wherein the retaining feature is configured to engage the first projection on the first locking member to resist forward movement of the first signal terminal cavity when the first connector is disconnected from the second connector.

20. A connector assembly, comprising:

a first connector including a first connector housing and a sliding mechanism, the first connector housing including a first power terminal cavity for receiving a first power terminal and a retaining member unitarily formed with the first connector housing, the retaining member including extension arms and a retaining feature extending between the extension arms, the sliding mechanism slidably engaging the first connector housing and including a first locking member unitarily formed with the sliding mechanism and a first signal terminal cavity for receiving a first signal terminal, the first locking member including a resilient arm and a first projection extending from the resilient arm, the retaining feature of the retaining member being configured to engage the first projection to maintain the first signal terminal cavity an axially retracted position relative to the first power terminal cavity; and a second connector including a second connector housing, the second connector housing including a second power terminal cavity for receiving a second power terminal, a second signal terminal cavity for receiving a second signal terminal, and a second projection, the second projection engaging the first projection when a first end face of the first connector housing engages a second end face of the second connector housing to deflect the first projection and the resilient arm away from the first connector housing such that the first projection is disengaged from the retaining feature and the first signal terminal cavity is allowed to slide axially toward the second signal terminal cavity.

* * * * *